United States Patent [19]

Lowder

[11] 4,088,148

[45] May 9, 1978

[54] FLOOR SCRUBBER SOLUTION VALVE

[75] Inventor: Dale E. Lowder, North Muskegon, Mich.

[73] Assignee: Clarke-Gravely Corporation, Muskegon, Mich.

[21] Appl. No.: 735,840

[22] Filed: Oct. 26, 1976

[51] Int. Cl.[2] ..... F16K 11/00; A47L 11/03

[52] U.S. Cl. ..... 137/625.47; 137/876; 15/50 R

[58] Field of Search ..... 137/625.46, 625.47, 137/610, 612, 876; 15/50 R, 98, 320, 321, ; 401/284, 136, 137, 270

[56] References Cited

U.S. PATENT DOCUMENTS

| | | | |
|---|---|---|---|
| 172,568 | 1/1876 | Hughes | 137/625.47 |
| 238,768 | 3/1881 | Drucklieb et al. | 137/625.47 |
| 627,019 | 6/1899 | Streubel | 137/625.16 |
| 2,108,299 | 2/1938 | Steffen | 137/625.12 |
| 2,138,767 | 11/1938 | Matthews | 251/183 |
| 2,632,467 | 3/1953 | Lamar | 137/509.2 |
| 3,185,179 | 5/1965 | Harautuneian | 137/625.47 |
| 3,370,612 | 2/1968 | Hull | 137/625.47 |
| 3,742,983 | 7/1973 | Harter | 137/625.47 |
| 3,851,349 | 12/1974 | Lowder | 15/50 R |

*Primary Examiner*—Martin P. Schwadron
*Assistant Examiner*—A. Michael Chambers
*Attorney, Agent, or Firm*—Price, Heneveld, Huizenga & Cooper

[57] ABSTRACT

A floor scrubber solution valve for dividing and metering a supply of cleaning solution to a pair of scrubbing brushes includes a generally cylindrical housing having an inlet port formed in one end and a pair of circumferentially spaced outlet ports formed in the wall of the housing. A generally circular valve or gate element is rotatably disposed in the housing. The valve element includes an inlet bore alignable with the housing inlet port upon rotation of the valve element. A transversely extending flow divider passage intersects the valve inlet bore and defines at each end valve element outlet ports. Diametrically opposed, narrow grooves formed in the valve element communicate with the flow divider passage and initiate flow from the inlet bore to the housing outlet ports as the inlet bore is aligned with the inlet port and maintain the flow to each of the outlet ports substantially equal.

25 Claims, 8 Drawing Figures

FLOOR SCRUBBER SOLUTION VALVE

BACKGROUND OF THE INVENTION

This invention relates to surface treatment apparatus of the type including at least a pair of surface treating elements and a supply source of liquid and, more particularly, to a unique solution valve for distributing liquid from the supply source at substantially equal rates to the surface treating elements.

Surface treatment apparatus such as floor scrubbers generally include at least a pair of surface treating elements in the form of brushes and a supply of liquid cleaning solution which is distributed to the surface treating elements. Provision is made for metering the flow of the solution to the elements and for dividing the flow equally between the two elements. Heretofore, a separate metering valve has been incorporated in the floor scrubber for controlling the rate of flow from the solution tank to a separate flow divider. Typically, the flow divider has been of the type including a divider chamber open to atmosphere and having separate outlets, each joined by a suitable conduit to the separate scrubber brushes. Systems of this type have not been totally satisfactory in dividing the liquid solution equally between the scrubbing brushes. Under high flow conditions, the fluid is usually fairly evenly distributed to the brushes but, however, under low flow rate conditions the solution tends to divide in the divider chamber unevenly.

Commonly owned U.S. Pat. No. 3,851,349 entitled FLOOR SCRUBBER FLOW DIVIDER, and issued on Dec. 3, 1974 in the name of the present inventor discloses an improvement over such prior flow divider systems. The flow divider illustrated therein is connected to a solution tank by a conduit through a metering valve. The flow divider includes a pair of separate outlet chambers with each chamber connected to a scrub brush. The divider has an inlet chamber including a number of symmetrical sets of fluid passageways, each of which sets empties into a respective outlet chamber. The passageways in each set are arranged vertically and the flow area increases from bottom to top.

This arrangement results in more evenly dividing the solution between the treating elements throughout the full range of flow rates provided by the metering valve. With this arrangement, however, it is possible for the flow divider chambers to overflow when the metering valve is fully opened and the solution tank is full of solution.

SUMMARY OF THE INVENTION

In accordance with the present invention, a unique solution valve is provided for metering and dividing the liquid solution between the floor treating elements whereby a substantially increased flow rate may be obtained with substantially equal flow rates to each of the scrubbing elements at less cost through the use of fewer components than heretofore possible. Essentially, the unique metering and flow divider valve includes a generally cylindrical housing defining a valve element chamber. The housing includes an inlet passage at one end and a pair of radially directed, circumferentially spaced outlet ports. A valve element is rotatably disposed in the housing. The element includes an inlet bore which is alignable with the housing inlet passage upon rotation of the valve element and a transversely extending divider passage. The divider passage intersects the inlet bore and the ends of the passage move into communication with the housing outlet ports as the valve element inlet bore is aligned with the housing inlet port. The valve element further includes first and second flow initiating means, each of which communicates with a respective end of the divider passage for initiating flow from the inlet bore through the housing outlet ports as the disc is rotated and for maintaining the flow rates to each of the outlet ports substantially equal as said valve element is rotated to a fully open position.

DETAILED DESCRIPTION OF THE PREFERRED EMBODIMENT

Figure 1:
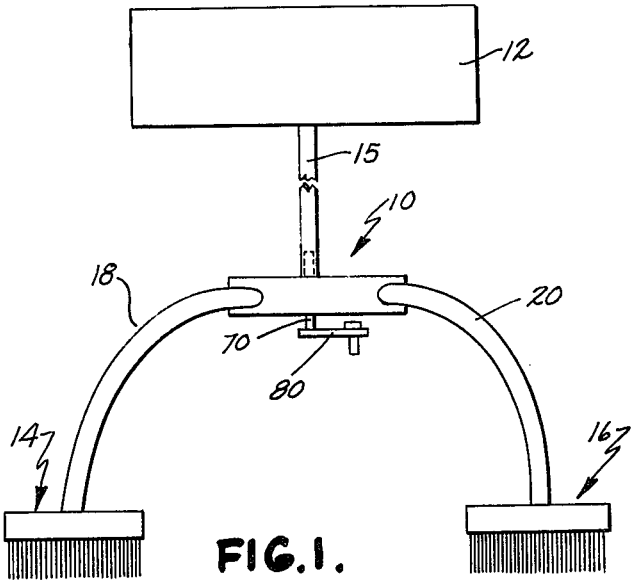
FIG. 1 is a schematic view illustrating the solution valve in accordance with the present invention connected between a supply source and a pair of surface treating elements.
Figure 5:
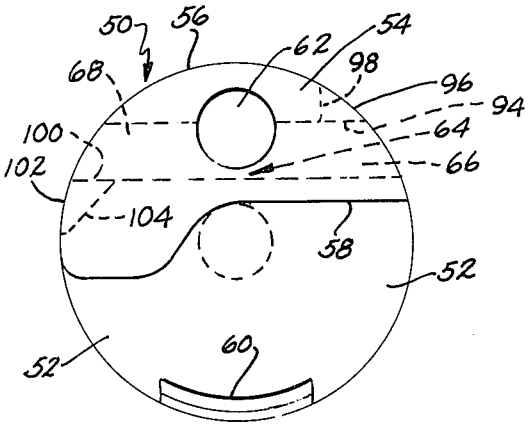
FIG. 5 is a top plan view of the valve element of the solution valve.

With reference to FIG. 1 of the drawings, the solution valve in accordance with the present invention, is generally designated 10 and is shown operably positioned between a solution supply tank 12 and a pair of scrubber brushes or surface treatment elements 14, 16. The solution contained in tank 12 flows to the solution valve 10 through a conduit 15. The solution is both metered and divided in substantially equal portions by the valve 10 and directed to the brush elements 14, 16 via conduits 18, 20.

Figure 2:
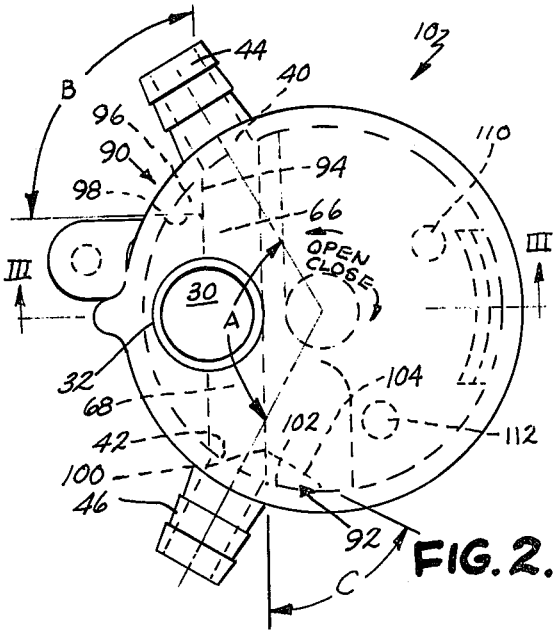
FIG. 2 is a top plan view of the solution valve in accordance with the present invention.
Figure 3:
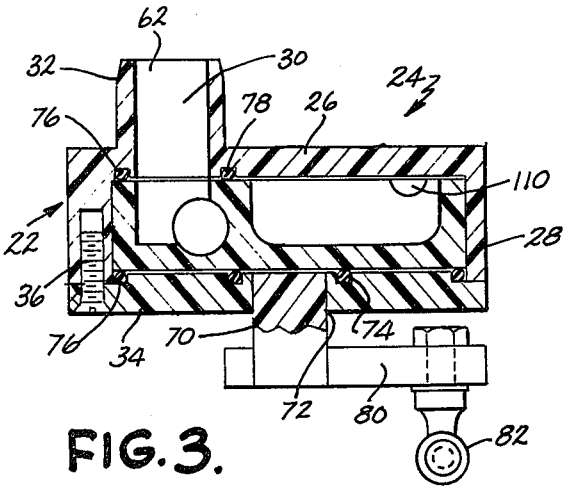
FIG. 3 is a side elevational view in cross section taken generally along line III—III of FIG. 2.
Figure 6:
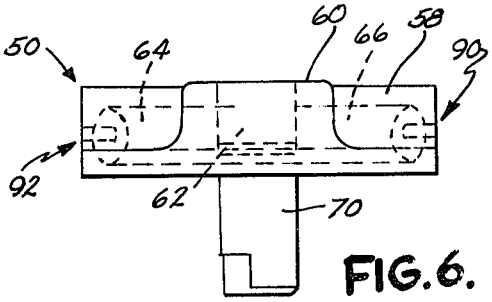
FIG. 6 is a rear, elevational view of the valve element of FIG. 5.
Figure 4:
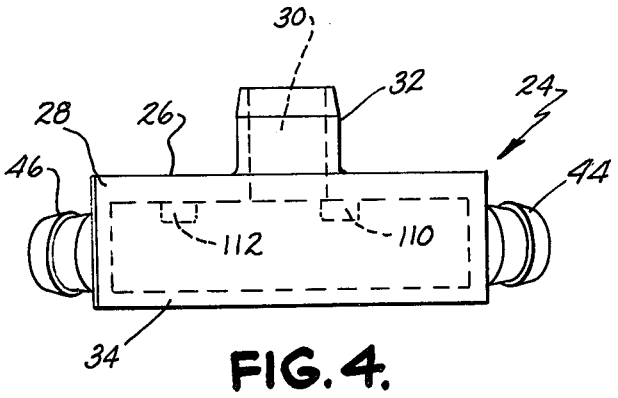
FIG. 4 is a rear, elevational view of the housing of the solution valve.

As best seen in FIGS. 2, 3 and 4, the unique solution valve in accordance with the present invention includes a housing 22. The housing 22 includes a cup-like, generally cylindrical member 24 including an end wall 26 and integral cylindrical skirt 28. An inlet port 30 is formed through the end wall 26 of the housing member 24. As best seen in FIGS. 2 and 3, the inlet port 30 is offset from the center line of the housing. Molded integral with end wall 26 is a generally cylindrical hose connector 32 which defines along with the port 30, an inlet passage.

The open end of the cup-like member 24 is closed by a removable cover plate 34. The cover plate is securable to the skirt 28 by suitable fasteners such as screws 36. Formed integral with the cylindrical skirt 28 and circumferentially spaced therearound are a pair of outlet ports 40, 42. These ports are cast with integral, barbed hose connectors 44, 46, respectively. The barbed hose connectors and the inlet ports define outlet passages which extend radially outwardly from the cylindrical skirt 28. As seen in the drawings, the housing is generally symmetrical about an axis passing through the center of the housing and the center of the inlet port 30. In the presently preferred form, the included angle between the outlet ports 40, 42 or the circumferential spacing of these ports is approximately 120° (angle A, FIG. 2).

Rotatably mounted within the chamber defined by the housing is a circular valve element or rotating valve gate 50. The valve element, as seen in FIGS. 2 and 3, has a diameter substantially equal to the inner diameter of the housing. As seen in FIGS. 5–8, the valve element 50 has a generally stepped shaped in vertical cross section and includes a disc or circular plate portion 52 having integral therewith a body portion 54 which defines a curved face 56 and a rear wall 58. Also, the valve element includes a curved guide wall 60 positioned opposite the body portion 54. The valve element 50 defines a vertically extending inlet bore 62 formed in the body portion 54. Extending transversely of the body portion 54 is a flow divider passage 64 which intersects the inlet bore 62. The flow divider passage 64 includes a first portion 66 which extends from the inlet bore 62 through the curved face 56 of the body portion to define a first outlet port and a second portion 68 extending from the element bore 62 through the curved face 56 to define a second outlet port.

Figure 7:
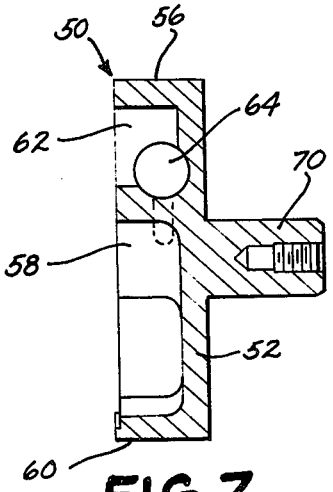
FIG. 7 is a cross-sectional view taken generally along line VII—VII of FIG. 6.
Figure 8:
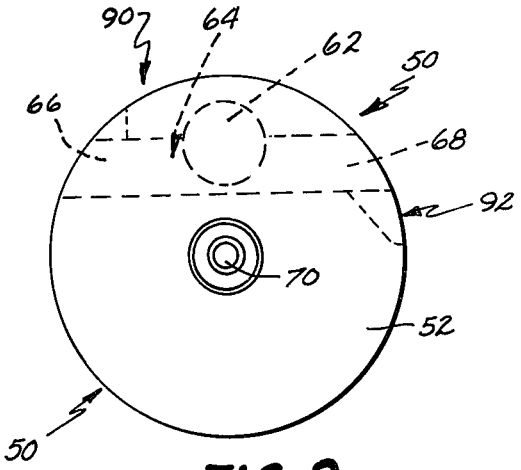
FIG. 8 is a bottom plan view of the valve element of the solution valve in accordance with the present invention.

In the preferred form, the first and second portions 66, 68 of the flow divider passage 64 are coaxial, of equal length and intersect the inlet bore 62, as seen in FIGS. 3 and 7, at an area offset from the vertical center line of the inlet bore. Further, the divider passage 64 has a diameter which is less than the diameter of the inlet bore for reasons which will be fully explained below. As best seen in FIG. 2, the inlet bore 62 and the flow divider passage 64 are formed in the valve element so that when the inlet bore 62 is aligned with inlet port 30 so that the center line of the inlet bore is coaxial with the center line of the inlet port, the center line of the divider passage corresponds to the segment of a secant between the secant's intersection with the housing at the centers of the housing outlet ports. This positioning of the valve element corresponds to a fully open position wherein maximum flow is obtained from the outlet ports.

The valve element 50 further includes an integral, depending stem 70 extending outwardly along the center line of the disc from the disc surface opposite the body portion 54. The cover plate 34 of the housing is provided with a central aperture 72 through which the stem 70 extends. In order to prevent leakage, the cover plate 34 is provided with an annular groove 74 within which is disposed a circular sealing element such as an O-ring 76. The O-ring is positioned to bear against the undersurface of the valve element. Further, the chamber facing surface of the end wall 26 is provided with a groove 77 around the inlet port 30. An O-ring 78 is disposed in this groove for sealing purposes. The housing and disc-like valve element having the inlet bore, therefore, provides for easy and effective sealing.

Suitable linkage (not shown) may be connected to a lever arm 80 nonrotatably secured to the free end of the valve stem 70 at a ball joint 82. Such linkage would interconnect the valve stem with a control provided on the handle of the floor scrubber and by which an operator could rotate the disc element to thereby meter or control the flow rate of solution from the tank 12 to the surface treating elements 14, 16.

As best seen in FIG. 2, when the valve element is rotated to its fully open position, substantially equal flow will be provided at the outlet ports 40, 42 of the housing. Provision is also made for providing substantially equal effective flow areas from each passage during the full range of travel of the valve element from a closed position to a fully open position.

As is readily apparent from FIG. 2, when the valve element is rotated in a counterclockwise direction, from a position where the inlet bore 30 and the outlets of the divider passage are not in communication with their respective ports on the housing, the first portion 66 of the divider passage will open to the outlet bore 40 of the housing before the second portion 68 of the divider passage opens to its corresponding outlet port 42. In order to provide substantially equal flow rates at each of the outlet ports 40, 42 during partial flow conditions, the valve element is provided with flow initiating means 90, 92.

Each of the flow initiating means is a narrow groove in the body 54, as best seen in FIGS. 2, 5, 6 and 8, having a generally triangular shape in plan view. Flow initiating means 90 includes a first open side 94, a second open side 96 and a third closed side 98. Flow initiating means 92 in like manner includes a first open side 100, a second open side 102 and a third closed side 104. The first side 94 of flow initiating means 90 extends along and opens into the first portion 66 of the flow divider passage. The second side 96 opens through a curved face 56 of the body portion. In like manner, the first side 100 of the initiating means 92 extends along and opens into the second portion 68 of the divider passage while the second side 102 opens through the curved face of the body portion.

The grooves are dimensioned so that as the valve element is rotated, the flow initiating means will open simultaneously along their second sides to their respective outlet ports as the inlet bore opens to the inlet port 30. As a result, flow is initiated at each of the outlet ports simultaneously. Further, the grooves are dimensioned so that the effective flow areas at each end of the divider passage provide equal flow rates through the outlet ports. Since the first portion of the divider passage would reach the outlet port 40 before the second portion reaches its respective outlet port, the first flow initiating means is dimensioned smaller than the second flow initiating means. In other words, the flow area of the first flow initiating groove defined by second open side 96 is less than the flow area of the second flow initiating groove defined by its second open side 102. The angle B between the first and third sides 94, 98, respectively, of the first flow initiating means in the preferred embodiment is approximately 90°. The angel C between the first and third sides 100, 104, respectively, of the second flow initiating means is approximately 45°.

As seen in FIGS. 2–5, the housing is also provided with stops 110, 112 formed integral with the inner surface of the end wall 26. These stops extend into the valve element chamber and are positioned so that the rear wall 58 of the body portion 54 will contact stop 110 when the valve is rotated to a closed position. In the closed position, the outlets of the divider passage are out of communication with the outlet ports 40, 42 and the inlet bore is out of communication with the inlet port 30. The stop 112 is positioned so that the rear wall which is configured, contacts it when the inlet bore is fully aligned with the inlet port and the ends of the divider passage open fully into the outlet ports 40, 42. When the valve is in the fully open position, the flow initiating means open into the inner surface of the skirt and the effective flow area at each outlet port is provided by the divider passage only.

As previously stated, the diameter of the divider passage is less than the diameter of the inlet bore and the inlet port. As a result, a pressure head is constantly maintained at the outlet port 40, 42 of the housing. This feature in conjunction with the flow initiating means ensures that an equal or substantially equal rate of solution is provided to the surface treating element.

In a presently preferred embodiment, the two-piece housing and one-piece valve element are molded from a modified, 20 to 30 percent glass filled phenylene oxide having a specific gravity of approximately 1.21 to 1.36, a tensile strength of 14,500 to 17,000 psi; water absorption (24 hrs. ⅛ thick%) of 0.06; an impact strength (ASTM No. D-256) of 1.4 to 1.5 ft. lb./in.; and an elongation of 4% to 6%. The valve element has a diameter of 2.372 to 2.366 inches and a height of 0.589 to 0.583 inches. The inlet bore has a diameter of 0.530 inches and a depth of 0.42 inches. The divider passage has a diameter of 0.375 inches. Each flow initiating means has a height between its upper and lower surfaces of approximately 0.06 inches. The center line of the flow divider passage is positioned 0.594 inches from the center of the valve element. The third side of the first flow initiating means is positioned generally parallel to a line passing through the center of the disc and the center of the inlet bore and spaced 0.65 inches therefrom. The third side of the second flow initiating means is angled with respect to the center line of the flow divider passage at an angle of 45° and terminates at the curved surface of the body at a point spaced 0.588 inches from the center line of the flow divider passage along a line perpendicular to the center line.

OPERATION

The valve element is initially in a closed position with the rear wall 58 abutting stop 110. The inlet bore 62 is completely out of communication with the inlet port 30 and the ends of the divider passage 64 are out of communication with the outlet ports 40, 42. As the valve element is rotated in a counterclockwise direction, when viewed as in FIG. 2, the inlet bore will begin to open to the inlet port and solution will flow into the divider passage. As side 96 of the first flow initiating means begins to open with port 40, side 102 of the second flow initiating means begins to open to port 42. The effective flow areas at each of the ends is substantially equal and the flow from inlet bore 62 is divided between the surface treatment elements 14, 16. The flow initiating means ensure equal rates at each outlet port 40, 42 until the rear wall contacts stop 112 and bore 62 is coaxial with inlet 30. At this point, the second sides 96, 102 of the initiating means open to the inner surface of the housing and the ends of the divider passage are in full flow communication with the outlet ports 40, 42 of the housing.

A solution valve in accordance with the above described presently preferred embodiment has obtained sufficiently equal flow rates to the surface treating elements through the entire range of flow of the valve and under full solution tank, half solution tank and quarter solution tank situations. Further, this valve has unexpectedly increased the flow to the brushes by approximately 400% with the valve fully opened and with a full solution tank when compared to the results obtained by the divider and metering valve combination disclosed in the aforementioned U.S. Patent. Further, the flow has been increased approximately 700% with the valve fully opened and with a quarter full solution tank.

The valve in accordance with the present invention is easily and readily manufactured employing conventional molding techniques at substantially reduced costs than heretofore possible. Further, the valve is relatively simple in that it includes only three major parts and replaces the previously employed metering valve and flow divider. The valve structure in accordance with the present invention permits molding the hose connectors integral with the housing thus eliminating the need for additional hose fittings and reducing the possiblility of leakage.

It is expressly intended that the above description should be considered as that of the preferred embodiment. Those skilled in the pertinent art might appreciate certain modifications in view of the foregoing disclosure. These modifications accordingly are to be considered as included in the appended claims unless these claims by their language expressly state otherwise.

The embodiments of the invention in which an exclusive property or privilege is claimed are defined as follows.

1. A solution valve for metering substantially equal rates of liquid from a supply source to a pair of floor treating elements comprising;

a housing defining a cylindrical valve element chamber and having an inlet port and a pair of outlet ports; and a valve element rotatably mounted in said chamber for rotation from a closed position to an open position, said valve element including:

means defining an inlet passage alignable with said housing inlet port as said valve element is rotated;

means defining a divider passage intersecting said inlet passage, the ends of said divider passage each having an effective flow area opening to said outlet ports upon rotation of said valve element;

first flow initiating means at one end of said divider passage for initiating flow at one of said outlet ports; and second flow initiating means at the other end of said divider passage for initiating flow at the other one of said outlet ports simultaneously with said first flow initiating means, each of said first and second flow initiating means opening into said divider passage and varying the effective flow area of the ends of said divider passage for maintaining substantially equal flow rates at said outlet ports during rotation of said valve element.

2. A solution valve as defined by claim 1 wherein said means defining said inlet passage and said divider passage comprises a body having said passages formed therein.

3. A solution valve as defined by claim 2 wherein said first flow initiating means comprises a first narrow groove formed in said body and opening into said divider passage.

4. A solution valve as defined in claim 3 wherein said second flow initiating means comprises a second narrow groove formed in said body and opening into said divider passage.

5. A solution valve for metering substantially equal rates of liquid from a supply source to a pair of floor treating elements comprising:

a housing defining a cylindrical valve element chamber and having an inlet port and a pair of outlet ports; and a valve element rotatably mounted in said chamber, said valve element including:

means defining an inlet passage;

means defining a divider passage intersecting said inlet passage, the ends of said divider passage opening to said outlet ports upon rotation of said valve element;

first flow initiating means at one end of said divider passage for initiating flow at one of said outlet ports; and second flow initiating means at the other end of said divider passage for initiating flow at the other one of said outlet ports simultaneously with said first flow initiating means, said first and second flow initiating means providing substantially equal flow rates at said outlet ports during rotation of said valve element, said means defining said inlet passage and said divider passage comprising a body having said passages formed therein, said first flow initiating means comprising a first narrow groove formed in said body and opening into said divider passage, said second flow initiating means comprising a second narrow groove formed in said body and opening into said divider passage and said first and second grooves being triangular in shape in plan, said first groove having a flow area less than the flow area of said second groove, and said grooves being dimensioned and shaped so that the effective flow areas at the ends of said flow divider passage, as the ends open to their respective outlet ports, are substantially equal.

6. In a surface treatment apparatus having at least a pair of surface treating elements, a supply source of liquid for distribution to said surface treating elements, the improvement comprising: a combined metering and distribution valve connecting said supply source to said surface treating element for metering and distributing liquid from said supply source at substantially equal rates to said surface treating elements, said valve including:

an enclosed housing having an inlet passage extending through one end of said housing, at least a pair of circumferentially spaced outlet ports, each operably connected to one of said surface treating elements; and a valve element movably positioned in said housing, said valve element having an inlet bore alignable with said housing inlet passage upon movement of said valve element, said valve element further having a flow divider passage in flow communication with said valve element inlet bore, the ends of said flow divider passage defining valve element outlet ports each of said valve element outlet ports being placeable in communication with said housing outlet ports as said valve element inlet bore is aligned with said housing inlet port, said valve element further including a first flow initiating means adjacent to and in communication with one of the ends of said divider passage and a second flow initiating means adjacent to and in communication with the other of the ends of said divider passage for gradually initiating flow from said inlet bore to a respective one of said housing outlet ports as said inlet bore is aligned with said inlet port and for maintaining the flow rates to each of said outlet ports substantially equal.

7. The apparatus as defined by claim 6 wherein the diameter of said divider passage is less than the diameter of said inlet bore.

8. The apparatus as defined by claim 7 wherein the center line of said inlet bore is parallel to the center line of said housing inlet passage, and positionable coaxial therewith upon movement of said valve element.

9. The apparatus as defined by claim 8 wherein said flow divider passage extends transversely of said valve element, intersecting said valve inlet bore; wherein the housing is generally circular in plan and wherein the center line of said divider passage corresponds to the segment of a secant between the secant's intersection with the housing at the centers of said housing outlet ports when the center line of said inlet bore is coaxial with the center line of said housing inlet passage.

10. The apparatus as defined by claim 9 wherein the divider passage intersects said inlet bore at the lower end of said inlet bore and offset from the center line of said inlet bore.

11. In a surface treating apparatus having at least a pair of surface treating elements, a supply source of liquid for distribution to said surface treating elements, the improvement comprising: a combined metering and distribution valve connecting said supply source to said surface treating element for metering and distributing liquid from said supply source at substantially equal rates to said surface treating elements, said valve including:

an enclosed housing having an inlet passage extending through one end of said housing, at least a pair of circumferentially spaced outlet ports, each operably connected to one of said surface treating elements; and a valve element movably positioned in said housing, said valve element having an inlet bore alignable with said housing inlet passage upon movement of said valve element, said valve element further having a flow divider passage in flow communication with said valve element inlet bore, the ends of said flow divider passage defining valve element outlet ports, each of said valve element outlet ports being placeable in communication with said housing outlet ports as said valve element inlet bore is aligned with said housing inlet port, said valve element further including a first flow initiating means adjacent to and in communication with one of the ends of said divider passage and a second flow initiating means adjacent to and in communication with the other of the ends of said divider passage for gradually initiating flow from said inlet bore to a respective one of said housing outlet ports as said inlet bore is aligned with said inlet port and for maintaining the flow rates to each of said outlet ports substantially equal, the diameter of said divider passage being less than the diameter of said inlet bore, the center line of said inlet bore being parallel to the center line of said housing inlet passage, and positionable coaxial therewith upon movement of said valve element, said flow divider passage extending transversely of said valve element, intersecting said valve inlet bore, the housing being generally circular and the center line of said divider passage corresponding to the segment of a secant between the secant's intersection with the housing at the centers of said housing outlet ports when the center line of said inlet bore is coaxial with the center line of said housing inlet passage, the divider passage intersecting said inlet bore at the lower end of said inlet bore and offset from the center line of said inlet bore, and each of said first and said second flow initiating means comprising said valve element having a groove in the periphery thereof, each of said grooves communicating with said divider passage and a valve element outlet port.

12. The apparatus as defined by claim 11 wherein the groove of said first flow initiating means has a flow area smaller than the flow area of the groove of said second flow initiating means and wherein the flow areas are dimensioned so that the liquid flow rate at said one of the said ends of said flow divider passage will be substantially equal to the liquid flow rate at the other end of said divider passage as the center line of said inlet bore is aligned coaxial with the center line of said housing inlet passage.

13. A solution valve for metering a treating solution from a supply source to at least a pair of floor treating elements, comprising:

a housing including a cup-like member having an end wall and an integral cylindrical skirt extending around the periphery of said end wall and a removable circular cover plate secured to the cup-like member to define therewith a cylindrical chamber, said end wall including a solution inlet port offset from the center thereof and said skirt including a pair of radially extending spaced outlet passages; and a circular disc rotatable in said chamber from a closed position to an open position having a generally stepped configuration in cross section and including a semi-circular body, said body having a curved face extending around a portion of the periphery of said disc, and a rear wall generally vertical to said disc, joining the ends of said curved face, said semi-circular body defining an inlet bore alignable with said solution inlet port as said disc is rotated to an open position, a first divider passage opening through said face of said body at one end and into said inlet bore at the other end, a second divider passage opening through said face of said body at one end and into said inlet bore at the other end, said divider passages communicating said inlet bore with said housing spaced outlet passages upon rotation of said disc, said semi-circular body further defining at least a pair of diametrically opposed flow initiating means, each of said means opening into one of said divider passages for varying the effective flow area from said passages to said housing outlet ports as said disc is rotated to a fully open position with said inlet bore aligned with said inlet port so that the flow rates through said housing outlets are substantially equal through the full range of rotation of said disc from said closed to said open positions.

14. A solution valve as defined by claim 13 wherein said first divider passage is of circular cross section and has a diameter less than the diameter of said inlet bore.

15. A solution valve as defined by claim 14 wherein said second divider passage is of circular cross section and has a diameter less than the diameter of said inlet bore.

16. A solution valve as defined by claim 13 wherein said first and second divider passages are coaxially aligned, are of equal length and each intersects said inlet bore at an area spaced from the center line of said inlet bore.

17. A solution valve as defined by claim 16 wherein each of said diametrically opposed flow initiating means comprise said semi-circular body having a narrow, generally triangular shaped groove opening into a respective one of said passages and through the curved face, whereby as said disc is rotated to place said inlet bore in alignment with said inlet port, said grooves simultaneously open to said outlet ports.

18. A solution valve as defined by claim 17 wherein each of said flow initiating means has a generally triangular shape in plan including a first side along the respective divider passage, a second side along the curved face and a third side connecting said first and said second sides.

19. A solution valve as defined by claim 18 wherein the included angle between said first side and said third side of one of said flow initiating means is approximately 45° and wherein the included angle between said first side and said third side of the other of said flow initiating means is approximately 90°.

20. A solution valve as defined by claim 19 wherein said outlet ports are spaced apart 120° along the circumference of said skirt.

21. A solution valve as defined by claim 20 wherein the flow area of said one of said flow initiating means is greater than the flow area of said other flow initiating means.

22. A solution valve as defined by claim 13 wherein said cup-like member includes a pair of spaced stops extending into said chamber, one of said stops positioned to be contacted by said rear wall when said disc is rotated to a closed position and the other of said stops positioned to be contacted by said rear wall when said disc is rotated to a fully open position and said inlet bore is aligned with said inlet port.

23. A solution valve as defined by claim 21 wherein said cup-like member includes a pair of spaced stops extending into said chamber, one of said stops positioned to be contacted by said rear wall when said disc is rotated to a closed position and the other of said stops positioned to be contacted by said rear wall when said disc is rotated to a fully open position and said inlet bore is aligned with said inlet port.

24. A solution valve as defined by claim 13 wherein said circular disc further includes a guide wall spaced from said body rear wall and extending along a portion of the circumference of said disc opposite said curved face.

25. A solution valve as defined by claim 23 wherein said circular disc further includes a guide wall spaced from said body rear wall and extending along a portion of the circumference of said disc opposite said curved face.

* * * * *